US006641745B2

(12) United States Patent
Tan et al.

(10) Patent No.: US 6,641,745 B2
(45) Date of Patent: Nov. 4, 2003

(54) METHOD OF FORMING A MANIFOLD IN A SUBSTRATE AND PRINTHEAD SUBSTRUCTURE HAVING THE SAME

(75) Inventors: Kee Cheong Tan, Singapore (SG); Pean Lim, Singapore (SG); Kiong Chin Chng, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/991,167

(22) Filed: Nov. 16, 2001

(65) Prior Publication Data

US 2003/0095166 A1 May 22, 2003

(51) Int. Cl.[7] ..... B41J 2/16

(52) U.S. Cl. ..... 216/27; 216/52; 216/53; 216/56; 216/62; 216/65; 216/79; 216/87; 216/94; 216/99

(58) Field of Search ..... 216/27, 52, 53, 216/56, 65, 79, 94, 99, 62, 87

(56) References Cited

U.S. PATENT DOCUMENTS 4,615,756 A * 10/1986 Tsujii et al. ..... 156/345.35
4,966,646 A * 10/1990 Zdeblick ..... 216/2
5,308,442 A 5/1994 Taub et al. ..... 156/644
5,385,633 A * 1/1995 Russell et al. ..... 438/708
5,387,314 A 2/1995 Baughman et al. ..... 156/643
5,441,593 A 8/1995 Baughman et al. ..... 216/27
5,658,471 A * 8/1997 Murthy et al. ..... 216/2
6,209,993 B1 * 4/2001 Wang et al. ..... 347/65
6,309,056 B1 * 10/2001 Sando et al. ..... 347/68

FOREIGN PATENT DOCUMENTS

JP 61270825 A * 12/1986 ..... H01L/21/302

OTHER PUBLICATIONS

Research Disclosure No. 261054, Jan. 10, 1986.*

* cited by examiner

*Primary Examiner*—Anita Alanko

(57) ABSTRACT

A method of forming a manifold through a substrate of a printhead substructure is disclosed. The substrate has an ink reservoir-facing side and an opposing transducer-supporting side. The transducer-supporting side of the substrate is introduced to an etchant. A laser beam is used to irradiate the etchant contacting side of the substrate. The irradiated areas of the substrate are thereby etched to define a first portion of the manifold therein. A second portion of the manifold is formed, preferably by sand blasting, to connect to the first portion. A printhead substructure that includes a substrate having a manifold formed according to the method is also disclosed.

1 Claim, 3 Drawing Sheets

METHOD OF FORMING A MANIFOLD IN A SUBSTRATE AND PRINTHEAD SUBSTRUCTURE HAVING THE SAME

BACKGROUND

This invention relates, generally, to a method of forming a manifold in a substrate of a printhead substructure, and more specifically, to a method of forming a manifold in a substrate using a laser-assisted etching process and a printhead substructure having such a substrate.

A prior art ink-jet printer typically includes a printing cartridge or pen in which small droplets of ink are formed and ejected toward a printing medium. Such pens include printheads with orifice plates having very small nozzles through which the ink droplets are ejected. Adjacent to the nozzles inside the printhead are ink chambers, where ink is stored prior to ejection. Ink is delivered to the ink chambers through ink channels. A manifold in the printhead connects to the ink channels to deliver ink from an ink supply to the ink chambers. The ink supply may be contained, for example, in a reservoir part of the pen.

Ejection of an ink droplet through a nozzle may be accomplished by quickly heating a volume of ink within the adjacent ink chamber. The rapid expansion of ink vapor forces a drop of ink through the nozzle. This process is called "firing." The ink in the chamber may be heated with a transducer, such as a resistor that is aligned adjacent to the nozzle. The length of the ink channel from the manifold to a resistor is commonly known as a shelf length of the particular resistor.

During firing, ink along an ink channel is forced away from the ink chamber towards the manifold. This ink that is forced away from the ink chamber will take a finite time to flow back towards the ink chamber. This finite time determines a maximum frequency at which a pen can be fired. During printing, a pen is mounted on a carriage and transported over a medium for printing on the medium. At any one time, only a fraction of the total number of nozzles can be fired. To compensate for displacement caused by carriage movement, the nozzles are staggered on the printhead to allow the printhead to print along a straight line perpendicular to an axis of carriage movement. This staggering of nozzles often results in different shelf lengths in the printhead. A longer shelf will take a proportionately longer time to refill after firing. The longest refill time therefore limits maximum frequency of operation of a pen. There is another problem associated with a printhead of non-uniform shelf lengths. With non-uniform shelf lengths, there will be differences between refill rates for the different ink chambers. The refill rate differences result in different drop volumes or weights for the different transducers which ultimately affect print quality.

Typically, the manifold is created by sand blasting a slot through a substrate of the printhead as disclosed in U.S. Pat. No. 5,478,606. During sand blasting, a stream of compressed air and sand particles is directed at the substrate to allow the sand particles to cut a slot through the substrate to define the manifold. Due to grain size variation and moisture content of the sand particles, an opening of the manifold at a transducer-supporting side of the substrate may be off-center and has jagged edges. Such an opening exacerbates the problem caused by non-uniform shelf lengths.

Impact on the substrate caused by sand blasting may also cause cracks in the transducer side of the substrate. The cracks result in leakage of ink from the manifold.

A combination process of wet etching and sand blasting bas been considered for forming a manifold having an opening that is more accurately centered and has a regular edge. This combination process involves (1) etching a recess in the transducer-supporting side of the substrate to define the opening and (2) sand blasting from the opposite side of the substrate to cut a slot that connects to the recess. Wet etching requires development of suitable masking layers for protecting the surface of areas of the printhead which are not to be etched. These masking layers are not trivial to develop. If not properly protected, an etchant used in wet etching will also etch away portions of the printhead that are not to be etched. The combination process therefore entails great care for implementation.

SUMMARY

According to an embodiment of the present invention, there is provided a method of forming a manifold through a substrate of a printhead substructure. The substrate has an ink reservoir-facing side and an opposing transducer-supporting side. The method includes (1) introducing an etchant that comes into contact with the transducer-supporting side of the substrate and (2) irradiating the etchant contacting side of the substrate using a laser beam. The irradiated areas of the substrate are etched to define a first portion of the manifold therein. The method further includes forming a second portion of the manifold that connects to the first portion. Preferably, forming the second portion includes sand blasting through the substrate from the ink reservoir-facing side of the substrate.

According to the embodiment of the present invention, there is provided a printhead substructure for an ink-jet pen. The substructure includes a substrate having a reservoir-facing side and an opposing transducer-supporting side. The transducer-supporting side of the substrate supports transducers. The substrate also supports a barrier layer that defines ink channels and ink chambers adjacent the transducers. A manifold is formed through the substrate for delivering ink from a reservoir through the ink channels to the ink chambers. The manifold is manufactured according to a method described above. The substructure further includes conductors for carrying electrical signals to activate the transducers.

BRIEF DESCRIPTION OF DRAWINGS

The invention will be better understood with reference to the drawings, in which.

DETAILED DESCRIPTION

Figure 1:
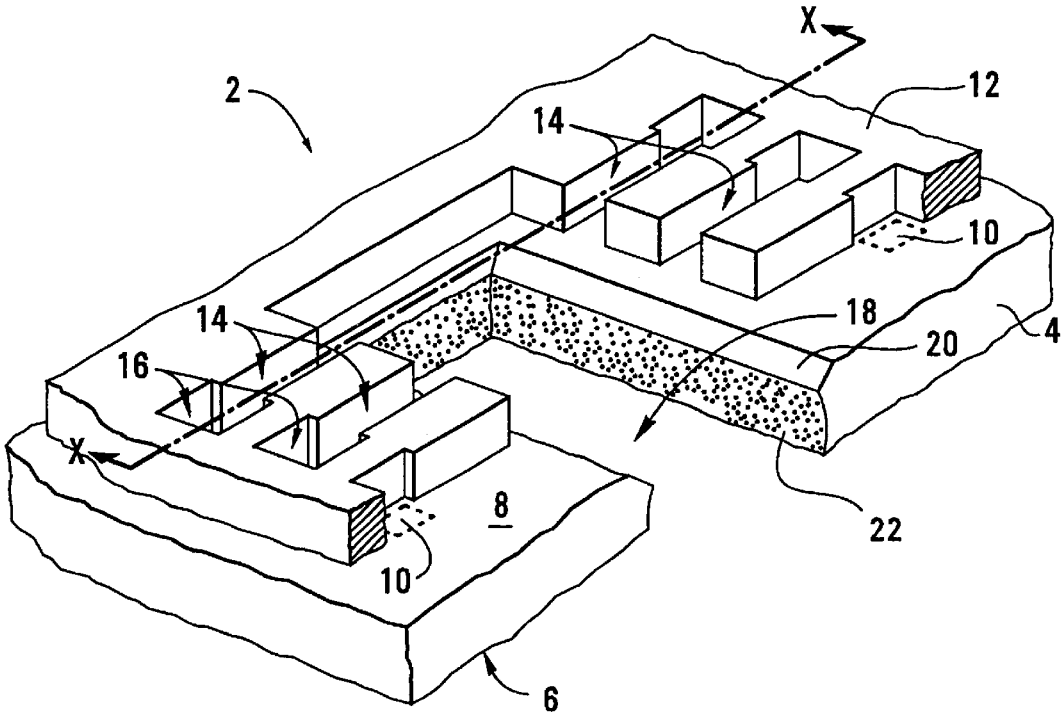
FIG. 1 is an enlarged isometric drawing of a portion of a printhead substructure having a manifold formed according to an embodiment of the present invention.

FIG. 1 is an enlarged isometric view of a printhead substructure 2 according to an embodiment of the present invention. The printhead substructure 2 includes a substrate 4 having a reservoir-facing surface or side 6 and an opposing transducer-supporting surface or side 8. The transducer-supporting side 8 of the substrate 4 supports a plurality of transducers 10. The transducer-supporting side 8 of the substrate 4 also supports a barrier layer 12 which is patterned to define ink channels 14 and ink chambers 16 adjacent the transducers 10. A manifold 18 formed through the substrate 4 delivers ink from a reservoir (not shown) through the ink channels 14 to the ink chambers 16. The manifold 18 has a first portion 20 adjacent the transducer-supporting side 8 that is connected to a second portion 22 adjacent the reservoir supporting side 6. The printhead substructure 2 also includes conductors (FIG. 2) for carrying electrical signals to activate the transducers 10. A laser-assisted etching process is used to form the first portion 20 of the manifold 18. The laser-assisted etching process will be described in details shortly. The second portion is formed using a non-laser-assisted process.

In use, ink flows from the manifold 18 through the ink channels 14 to fill the ink chambers 16. When an electric current pulse is allowed to pass through the transducers 10, thermal energy is produced. The thermal energy heats the ink in the ink chambers 16 to cause an explosive vapor formation. The vapor formation in the ink chambers 16 forces droplets of ink out of corresponding nozzles 24 in an orifice plate 26 (FIG. 2).

Figure 2:
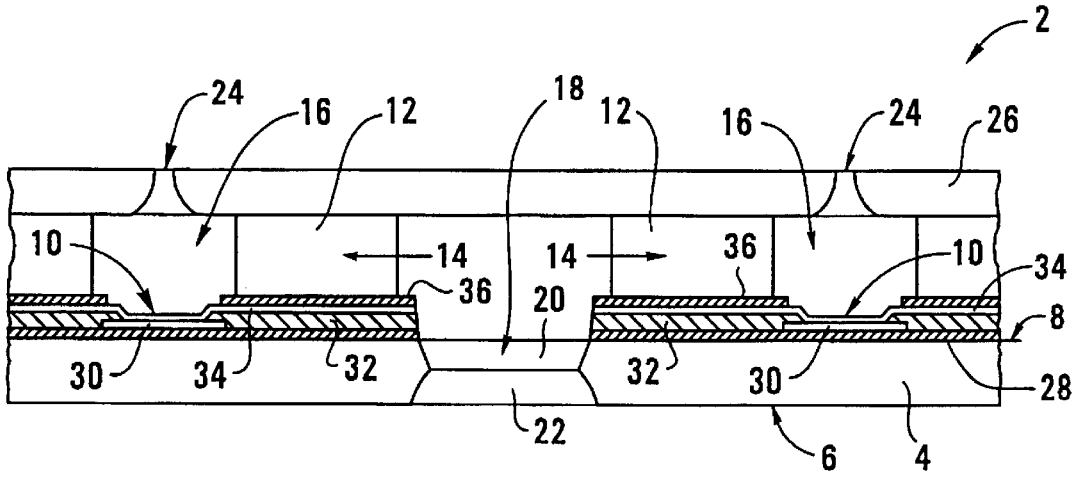
FIG. 2 is a sectional drawing of the printhead substructure in FIG. 1 taken along a line X—X.

FIG. 2 is an enlarged cross-sectional view of the printhead substructure taken along a line X—X in FIG. 1. This cross-sectional view includes the orifice plate 26 attached to the barrier layer 12 of the printhead substructure 2.

An illustrative manufacturing process of the printhead substructure 2 is described next. An insulation layer 28 is applied onto the transducer-supporting side 8 of the substrate 4. An example of the substrate 4 is a silicon wafer. The insulation layer 28 thermally and electrically insulates the substrate 4. It is noted that this insulation layer 28 may be omitted altogether. Next, a layer of resistive heating material 30 is typically deposited over the insulated substrate 4 for forming the transducers 10 thereon. A conductive layer 32 is then deposited over the resistive material 30. Patterns on the conductive layer 32 and the resistive layer 30 are lithographically formed using conventional masking, ultraviolet exposure and etching techniques to dimensionally define the transducers 10. One or more passivation layers 34 are applied over the conductive and resistive layers 32, 30 and then selectively removed to create vias (not shown) for electrical connection of a second conductive layer 36 to the conductive traces formed out of the first conductive layer 32. The second "interconnect" conductive layer 36 is patterned to define a discrete conductive path from each trace to an exposed bonding pad (not shown) remote from the corresponding transducer 10. The bonding pad facilitates connection with a conductive lead from a flexible circuit (not shown) that is carried on the pen. The circuit conveys control or "firing" signals from a microprocessor (not shown) to the transducers 10. The substructure 2 is overlaid with an ink barrier layer 12. The ink barrier 12 is etched using a photolithographic process to pattern the ink channels 14 and the ink chambers 16 that is situated above, and aligned with, the tranducers 10.

Figure 3A:
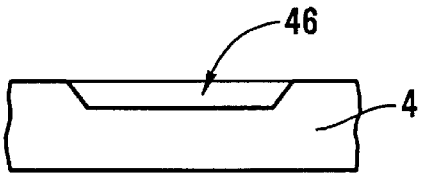
FIGS. 3A and 3B are side and plan views of a substrate having a first portion of a manifold formed by a laser-assisted etching process.
Figure 4A:
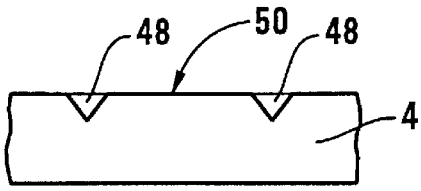
FIGS. 4A–4D are similar to FIGS. 3A–3D showing a first portion of the manifold formed by a variation of the laser-assisted etching process in FIGS. 3A–3D.
Figure 3B:
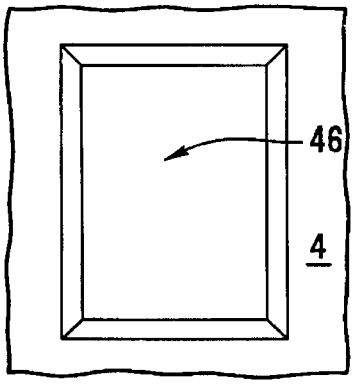
Figure 4B:
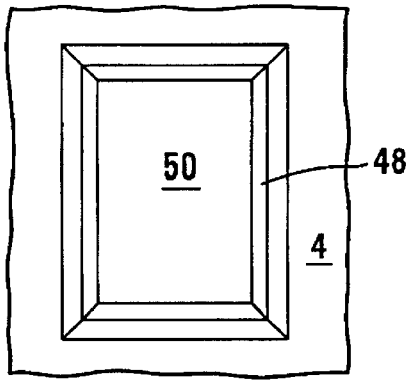
Figure 3C:
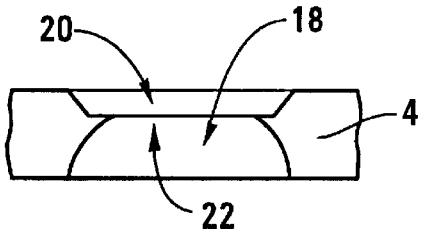
FIGS. 3C and 3D are similar to FIGS. 3A and 3B shown with a second portion of the manifold sand-blasted through the substrate to connect to the first portion in FIGS. 3A and 3B.
Figure 4C:
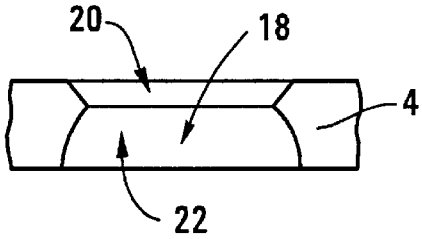
Figure 3D:
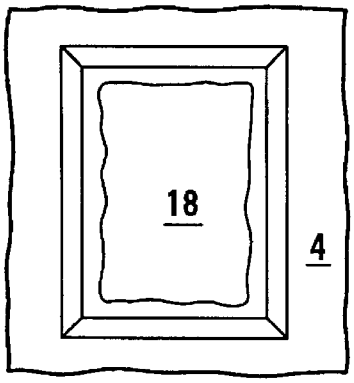
Figure 4D:
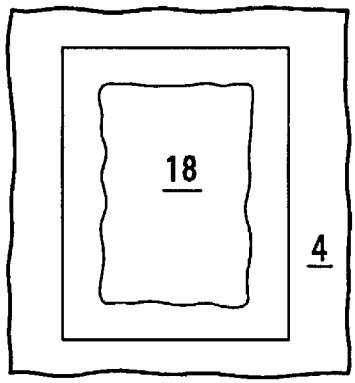

The process of forming the manifold 18 through the substrate 4 according to an embodiment of the present invention is next described. The printhead substructure 2 is immersed in an etchant 40 in a chamber 42 to introduce and allow the transducer-supporting side 8 of the substrate 4 to come in contact with the etchant 40. Preferably, the etchant 40 has a slow etching rate. The etchant 40 is preferably circulated to assist in removing etched debris and to prevent build-up of heat caused by laser irradiation that may result in cracks. Next, a controlled laser beam 44 is used to selectively irradiate the transducer-supporting side 8 of the substrate 4 that is in contact with the etchant 40. Irradiated areas on the substrate 4 become activated and react with the etchant 40. This reaction causes corrosion of the irradiated areas. The irradiated areas on the substrate 4 are therefore etched to define the first portion 20 of the manifold 18 therein. A recess 46 may be etched out of the substrate 4 to define the first portion 20 as shown in FIGS. 3A and 3B. Alternatively, a groove 48 may be etched along a perimeter of a pre-determined opening of the manifold 18 on the transducer-supporting side 8 as shown in FIGS. 4A and 4B. Etching of the groove 48 leaves a substrate island 50 that is surrounded by the groove 48. Such a laser-assisted etching process does not result in any mechanical impact on the substrate 4 and therefore reduces the risk of chipping or cracking of the substrate 4. After the first portion 20 of the manifold 18 is formed, the printhead substructure 2 is cleaned and dried.

The second portion 22 of the manifold 18 is preferably formed after the first portion 20 using the non-laser-assisted process. This non-laser-assisted process includes sand blasting, laser drilling or other like processes known to those skilled in the art. Preferably, sand blasting is performed from the reservoir-facing side 6 of the substrate 4 to define the second portion 22. Sand blasting continues until the second portion 22 connects to the recess 46 or the second portion 22 meets with the groove 48 to remove the substrate island 50 as shown in FIGS. 3C and 3D, and FIGS. 4C and 4D respectively.

Figure 5:
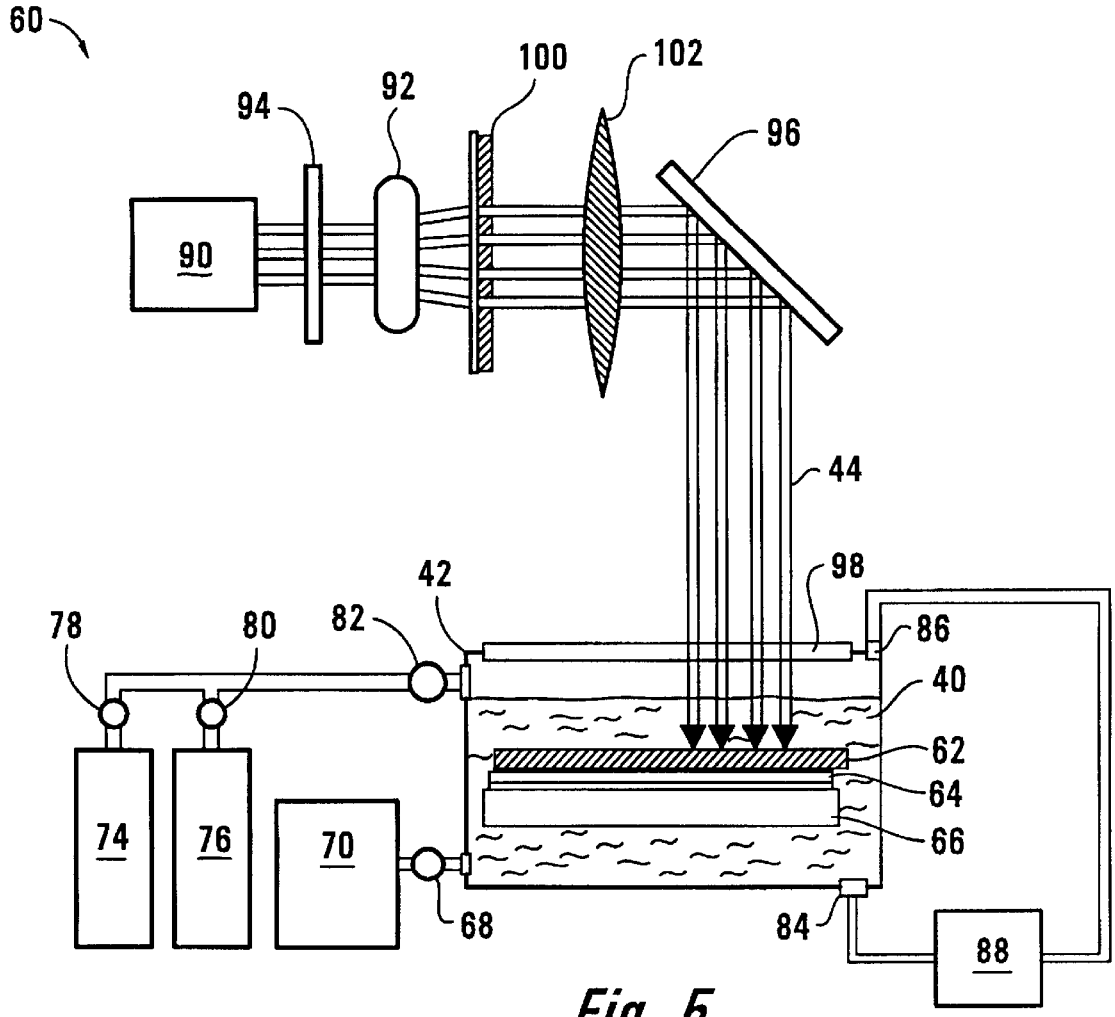
FIG. 5 is a schematic drawing of a combination apparatus suitable for forming the first portion of the manifold using the laser-assisted etching process.

FIG. 5 illustrates a combination apparatus 60 suitable for implementing several variations of the laser-assisted etching process. The variations will be discussed shortly. The apparatus 60 includes a contact mask 62 that has appropriately patterned openings (not shown) for selectively illuminating and hence selectively etching the substrate 4. The chamber 42 is filled with the etchant 40, which may either be gaseous or aqueous. The chamber 42 may be of a high corrosion resistant material such as that commercially available from E. I. DuPont de Nemours Company (Wilmington, Del.) under the trademark Teflon. The etchant 40 may also be acidic or basic as is known in the art. It is important that the etchant 40 that does not degrade the other layers 32–36 supported by the substrate 4. The chamber 42 is large enough to accommodate a wafer 64 that includes a plurality of printhead substructures 2. The wafer 64 is supported by a fixture 66, which may also serve to move or translate the wafer 64 by means of a motorized X-Y stage.

If the etchant 40 is gaseous, the chamber 42 can be evacuated through a valve 68 connected to a vacuum pump 70. The chamber 42 can then be back-filled with a selected gas from one of several reservoirs, of which reservoirs 74 and 76 are representative. Individual valves 78, 80, 82, allow for control of the pressure of a given gas in the chamber 42. Gases in reservoirs 74, 76 and the vacuum pump 70 are used to selectively control the gaseous etchant in the chamber 42.

If the etchant 40 is aqueous, the chamber 42 can include an inlet 86 and an outlet 84. The etchant 40 leaves the chamber 42 through the outlet 84. The etchant 40 is pumped back into the chamber 42 through the inlet by a pump 88. Some examples of aqueous etchants are HF, $HNO_3$, $H_3PO_4$, KOH and $CF_4$.

The laser beam 44 is generated with a laser source 90. The beam 44 may be conditioned using optics 92, further controlled by a shutter mechanism 94, and may be deflected via an electro-optical or mechanical means 96. These means 96 include mirrors and variable filters. Suitable mirrors are one-inch diameter fused silica mirrors with a flat surface. The flat surface has a coating that is highly reflective for a beam at a 45 degree angle of incidence. The mirrors are used to change the beam path without altering a wavefront shape of the beam 44. The filters are capable of reducing the power of the laser beam by up to 90%. An optically transparent window 98, preferably of sapphire, is formed in one side of chamber 42 to allow entry of the laser beam 44. According to the variations in the laser-assisted etching process, the substrate 4 can be selectively illuminated by the laser beam 44 through use of the contact mask 62 or by a projection mask 100. A projection lens 102 can be used in combination with the projection mask 42 to alter the beam 44, with or without a change in magnification of the beam 44.

The laser source 90 has an output power of approximately 5 watts. Laser sources of other output powers may also be used. The laser source 90 may be a pulsed Argon ion laser operating at a wavelength of 514.5 nm. Alternatively, the laser source 90 may be a pulsed Nd:YAG operating at a wavelength of 532 nm or 355 nm.

Figure 6A:
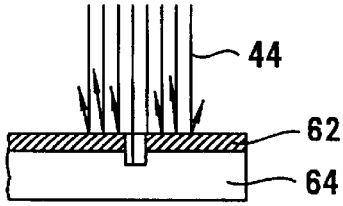
FIGS. 6A–6C show variations of the laser-assisted etching process using the apparatus in FIG. 5.
Figure 6B:
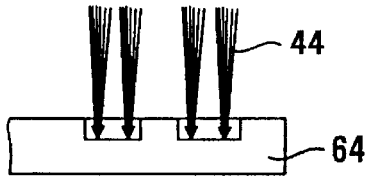
Figure 6C:
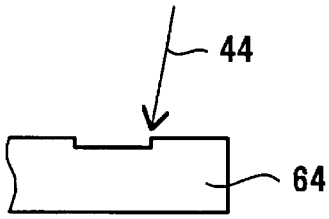

FIGS. 6A–6C illustrate details of the variations of selectively illuminating or irradiating the wafer 64. In FIG. 6A, an unpatterned beam 44 is used to illuminate the wafer 64 through the contact mask 62 that is held either in contact or in close proximity with the wafer 64. In FIG. 6B, the projection mask 100 defines an image-carrying laser beam 44 that is used to induce etching on the wafer 64, without the need for a contact mask 62. Finally, in FIG. 6C a finely focused laser beam 44 is scanned across the wafer 64 to selectively illuminate and hence selectively etch the wafer 64. Use of a scanned laser beam 44 eliminates the need for the projection mask 100 or the contact mask 62. The beam optics 92 focuses the laser beam 44 on the wafer 64 to an appropriate spot size at an energy density known to those skilled in the art. The laser beam 44 is directed at the wafer 64 at approximately 2.5 degree from the normal axis to avoid reflection of the beam into the laser source 90. The intensity of a reflected beam into the laser source 90 may cause instability in the laser source 90 or damage to the optical coatings on the electro-optical or mechanical means 96.

The mechanical means 96, such as a scanner, scans the spot over the wafer to selectively etch the wafer. Suitable scanners are galvanometer scanning mirrors or electro-optic deflectors. Alternatively, the wafer 64 can be selectively illuminated by keeping the spot stationary and translating the wafer 64 using the translation stage 66. A suitable translation stage 43 is a crossed roller bearing X-Y stage with linear motor drives and glass scale encoders. For translation in the Z direction, that is perpendicular to a plane defined by the X-Y stage, a similar cross roller bearing stage with a rotary DC motor and a glass scale encoder can be used. Optimally, the three axes X, Y, and Z system is closed-loop servo-controlled, as is known in the art. Step and repeat techniques are typically used in order to expose the whole wafer to the laser radiation.

Advantageously, the laser-assisted etching of the manifold opening according to the invention allows the manifold to be more accurately formed. The edges of the opening are also more regular to result in relatively more uniform shelf lengths.

While the present invention has been shown and described with reference to the foregoing operational principles and preferred embodiment, it will be apparent to those skilled in the art that other changes in form and detail may be made. As an example, the substrate may be etched using the laser-assisted process to define a manifold opening of various shapes, depths and sizes.

We claim:

1. A method of forming a manifold through a substrate of a printhead substructure, the substructure having an ink reservoir-facing side and an opposing transducer-supporting side, the method comprising:

Introducing an etchant that comes into contact with the transducer-supporting side of the substrate;

Irradiating the etchant contacting side of the substrate using a laser beam so that irradiated areas are etched to define a first portion of the manifold therein; and Forming a second portion of the manifold through the substrate to connect with the first portion, wherein the irradiated areas are etched to form a groove along a perimeter of a pre-determined opening of the manifold on the transducer-supporting side to leave a substrate island that is surrounded by the groove and wherein forming the second portion of the manifold includes sand blasting through the substrate from the ink reservoir side to remove substrate island.

* * * * *